US010780317B1

(12) United States Patent
Sawhney

(10) Patent No.: US 10,780,317 B1
(45) Date of Patent: Sep. 22, 2020

(54) EXERCISE APPARATUS

(71) Applicant: Chetan Sawhney, Houston, TX (US)

(72) Inventor: Chetan Sawhney, Houston, TX (US)

( * ) Notice: Subject to any disclaimer, the term of this patent is extended or adjusted under 35 U.S.C. 154(b) by 59 days.

(21) Appl. No.: 16/176,941

(22) Filed: Oct. 31, 2018

(51) Int. Cl.

| | |
|---|---|
| ***A63B 23/12*** | (2006.01) |
| ***A63B 21/00*** | (2006.01) |
| ***A63B 21/068*** | (2006.01) |
| ***A63B 23/035*** | (2006.01) |

(52) U.S. Cl.
CPC .... *A63B 23/1236* (2013.01); *A63B 21/00047* (2013.01); *A63B 21/068* (2013.01); *A63B 21/4035* (2015.10); *A63B 23/0355* (2013.01); *A63B 23/03516* (2013.01); *A63B 2209/00* (2013.01)

(58) Field of Classification Search
CPC ..... A63B 21/00047; A63B 21/068; A63B 21/4035; A63B 23/03516; A63B 23/0355; A63B 23/1236; A63B 1/00
See application file for complete search history.

(56) References Cited

U.S. PATENT DOCUMENTS

| | | | | |
|---|---|---|---|---|
| 4,610,448 A | | 9/1986 | Hill | |
| 5,226,868 A | * | 7/1993 | Montgomery | A63B 21/4035 482/141 |
| 5,230,684 A | * | 7/1993 | Wallisch | A63B 23/12 482/141 |
| 6,129,651 A | * | 10/2000 | Denaro | A63B 21/00047 482/141 |
| 6,932,750 B1 | * | 8/2005 | Dorner | A63B 23/12 482/141 |
| 7,588,521 B1 | | 9/2009 | Fazzari | |
| 8,088,052 B1 | * | 1/2012 | Sprague | A63B 21/0004 482/131 |
| 10,183,188 B2 | * | 1/2019 | Burke | A63B 7/02 |
| D848,556 S | * | 5/2019 | Bolillo | A63B 21/00178 D21/691 |
| 2005/0227836 A1 | * | 10/2005 | Wen | A63B 21/068 482/141 |
| 2012/0040811 A1 | * | 2/2012 | DeTore | A63B 21/00047 482/141 |
| 2016/0074693 A1 | * | 3/2016 | Henry | A63B 21/068 482/141 |
| 2018/0169468 A1 | * | 6/2018 | Barrie, III | A63B 21/4035 |

OTHER PUBLICATIONS

Website:https://www.sciencedirect.com/science/article/pii/S0301679X1200340 published: Apr. 2013 (Year: 2013).*

* cited by examiner

*Primary Examiner* — Megan Anderson
(74) *Attorney, Agent, or Firm* — Sanchelima & Associates, P.A.; Christian Sanchelima; Jesus Sanchelima

(57) ABSTRACT

The present invention discloses a push-up exercise apparatus for performing push-up, particularly in close triceps position. The push-up exercise apparatus comprising a base member, a pair of spaced apart first support members centrally disposed on the base member at an angle of at least forty-five degrees, a pair of spaced apart second support members centrally disposed on the base member at an angle of at least forty-five degrees and parallel to the pair of first support members, a first handle disposed above the pair of spaced apart first support members and a second handle disposed above the pair of spaced apart second support members. The apparatus further enables to adapt a healthy lifestyle, aids in eliminating flabby arms and weak pectoral muscles and sculpts pectoral and triceps muscle.

10 Claims, 4 Drawing Sheets

EXERCISE APPARATUS

BACKGROUND OF THE INVENTION

1. Field of the Invention

The present disclosure relates to an exercise apparatus. More specifically, the present disclosure relates to a push-up exercise apparatus for performing push-up, particularly in close triceps position.

2. Description of the Related Art

Exercise is an important part of many people's daily lives, that enhances physical fitness, overall health, and wellness. In particular, push-up is an exercise known to be beneficial for many people. Push-up is known to exercise several muscle groups, including the triceps, pectoral, deltoid and back muscles. A person positions their body in a prone position with their chest down and their hands on the floor. The exercise is performed by raising and lowering their body using their arms while resting either their feet or knees on the floor. In conventional push-up, with the hands placed directly on a hard surface such as floor, limits the possible benefits. Further, the person's wrist is bent 90 degrees, which may subject to injury or slipping of hand from the floor or supporting surface, particularly, while performing push-up in close triceps position.

Several devices have been designed in the past. None of them, however, include a push-up exercise apparatus that is capable of addressing the foregoing discussed issues.

Applicant believes that a related reference corresponds to U.S. Pat. No. 4,610,448A filed by David L. Hill describes a hand grip for push-ups. The David reference is comprised of a cylindrical handle which is mounted in a U-shaped clevis in a manner to rotate about a horizontal axis. The clevis is mounted relative to the base which supports the device in a manner to rotate about a vertical axis. While performing push-up, the device allows the user to rotate his or her hand about a horizontal axis, in order to position the wrist at a comfortable position, and about a vertical axis, in order to simultaneously rotate the arm while extending or contracting it. However, the rotating function of the David reference cannot be used by all age groups as it requires more focus and training in balancing the rotation functionality. Further, the use of David reference without proper practice and control may result in spraining of wrists.

Another related reference is U.S. Pat. No. 7,588,521B1 filed by Carlo Fazzari discloses a push-up exercise apparatus. The Carlo reference discloses a device for performing weighted push-ups in a safe environment. The device comprises a) a pair of hollow, parallel supports, b) a pair of essentially symmetrical L-shaped arms, comprising a vertically downward segment and a horizontal segment, said vertically downward segments adapted to be vertically moveable within said parallel supports, c) a pair of essentially parallel guide elements affixed to the horizontal segment each of the L-shaped arms, and d) a weight support platform attached to upright rods that are slideable within the guide elements. However, the Carlo reference is complex in design and lacks portability feature.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a push-up exercise apparatus for performing push-up, particularly in close triceps position.

It is another object of the present invention to provide the push-up exercise apparatus for performing push-up without physical strain and injury.

It is yet another object of the present invention to provide the push-up exercise apparatus with portability, compactness and inherent rigidity features.

It is yet another object of the present invention to provide the push-up exercise apparatus to effectively isolate and target the triceps and pectoral muscles.

It is yet another object of the present invention to provide the push-up exercise apparatus for users over a wide range of ages, fitness levels, heights, and weights.

It is yet another object of the present invention to provide the push-up exercise apparatus comprising a base member, a pair of spaced apart first support members centrally disposed on the base member at an angle of at least forty-five degrees, a pair of spaced apart second support members centrally disposed on the base member at an angle of at least forty-five degrees and parallel to the pair of first support members, a first handle disposed above the pair of spaced apart first support members and a second handle disposed above the pair of spaced apart second support members.

It is yet another object of the present invention to provide the push-up exercise apparatus made of acrylonitrile butadiene styrene (ABC) or any rigid material.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
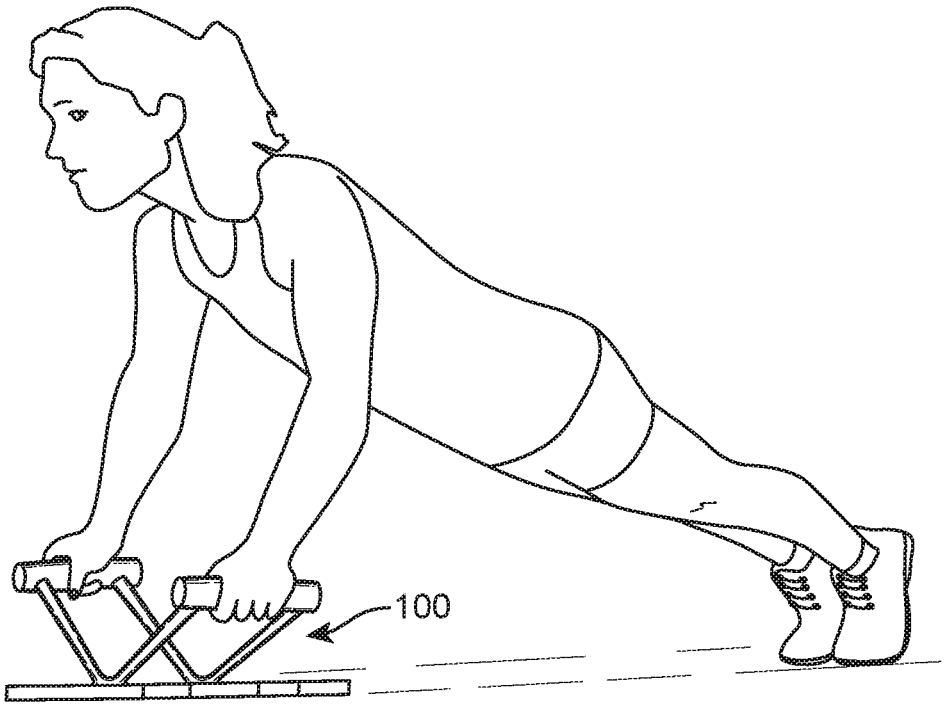
FIG. 1 exemplarily illustrates a perspective view of a user performing push-up using a push-up exercise apparatus 100 according to an embodiment of the present invention.
Figure 2A:
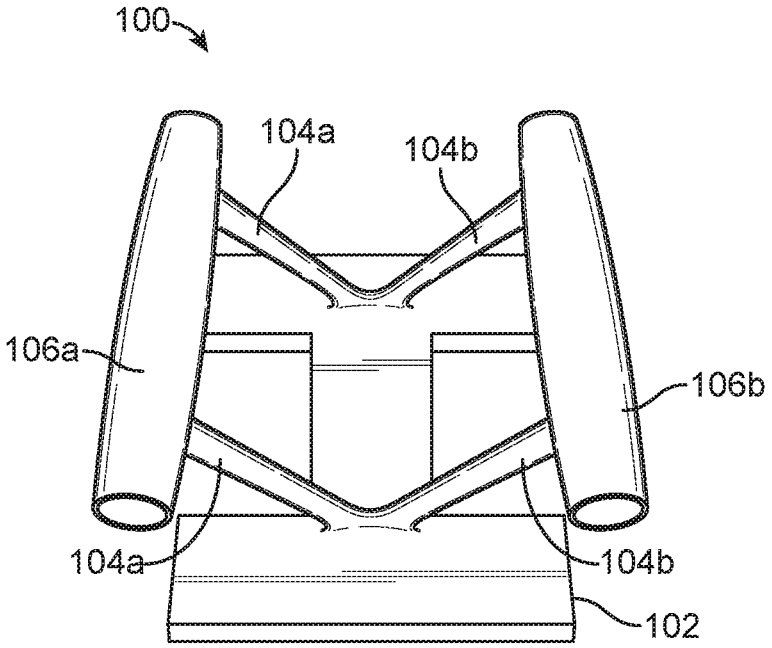
FIG. 2A exemplarily illustrates a perspective view of the push-up exercise apparatus 100 according to an embodiment of the present invention. The push-up exercise apparatus 100 comprising a base member 102, a pair of spaced apart first support members 104*a* centrally disposed on the base member 102 at an angle of at least forty-five degrees, a pair of spaced apart second support members 104*b* centrally disposed on the base member 102 at an angle of at least forty-five degrees and parallel to the pair of first support members 104*a*, a first handle 106*a* disposed above the pair of spaced apart first support members 104*a* and a second handle 106*b* disposed above the pair of spaced apart second support members 104*b*, is illustrated.
Figure 2B:
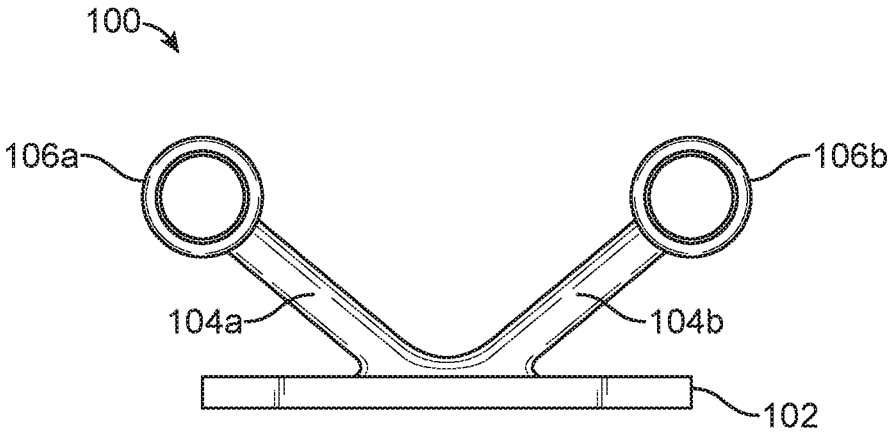
FIG. 2B exemplarily illustrates a front view of the push-up exercise apparatus 100 according to an embodiment of the present invention.
Figure 2C:
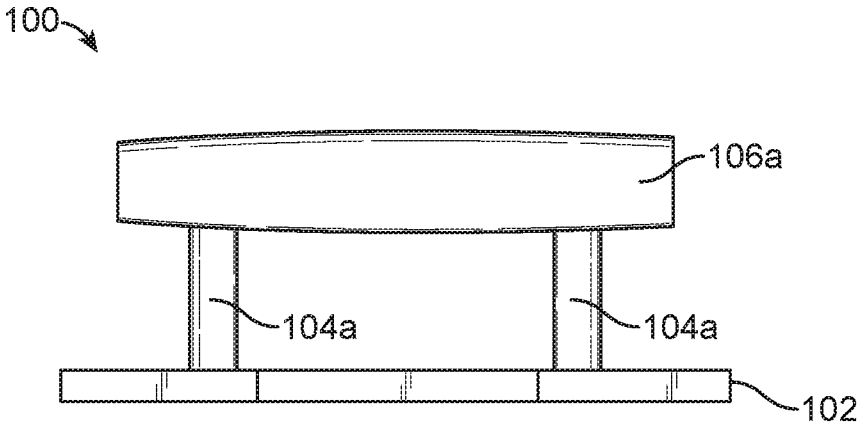
FIG. 2C exemplarily illustrates a side view of the push-up exercise apparatus 100 according to an embodiment of the present invention.
Figure 3:
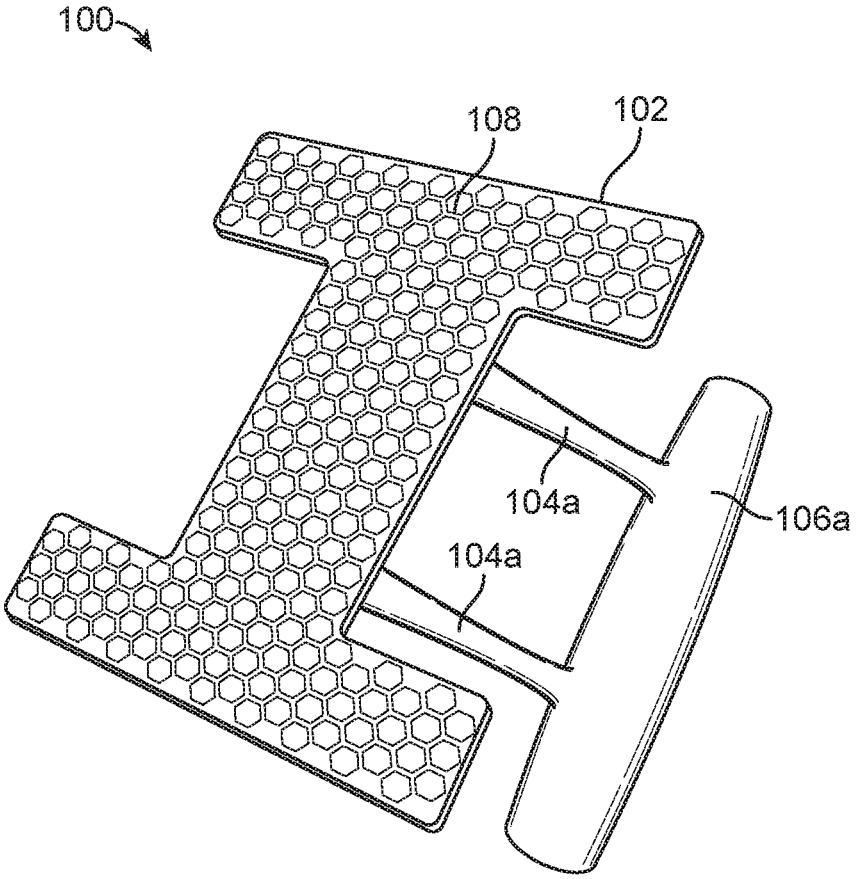
FIG. 3 exemplarily illustrates a rear side of the base member 102 according to an embodiment of the present invention. The rear side of the base member 102 comprising a honeycomb texture 108, is illustrated.

Referring now to the drawings, FIGS. 1-3, where the present invention is generally referred with numeral 100, it can be observed a push-up exercise apparatus 100 for performing push-up, particularly in close triceps position or closed hand position, is disclosed.

The apparatus 100 comprises a base member 102, a pair of first support member 104*a*, a pair of second support member 104*b*, a first handle 106*a* and a second handle 106*b*. The base member 102 comprises a first end surface and a second end surface. In one embodiment, a rear side of the base member 102 comprises a textured surface. In another embodiment, the rear side of the base member 102 comprises a honeycomb texture 108. The pair of spaced apart first support members 104*a* is centrally disposed on the first end surface of the base member 102 at an angle of at least forty-five degrees. The pair of spaced apart second support members 104*b* centrally disposed on the second end surface of the base member 102 at an angle of at least forty-five degrees and parallel to the pair of first support members 104*a*. In one embodiment, the pair of spaced apart first support members 104*a* extends upward and outward to the right and the pair of spaced apart second support members 104*b* extends upward and outward to the left, to form a V-shaped space therebetween.

The first handle 106*a* disposed above the pair of spaced apart first support members 104*a*, and the second handle 106*b* disposed above the pair of spaced apart second support members 104*b*. The first and second handle or the handles (106*a*, 106*b*) have any desired shape, but not limited to, cylindrical, oval, or rectangular. Optionally, the handles (106*a*, 106*b*) may be covered by a gripping material, but not limited to, foam, rubber or the like. The base member 102, the handles (106*a*, 106*b*) and the pair of first and second support members (104*a*, 104*b*) form a unitary body. In an embodiment, the handles (106*a*, 106*b*) and pair of first and second support members (104*a*, 104*b*) are formed integral with the base member 102 or formed independently by any known means, such as moulding, casting and secured to the base member 102 by any known means, such as, by way of non-limiting example, fasteners, adhesives or the like.

In an embodiment, the base member 102 is rectangular in shape. In one embodiment, the base member 102 is 'I' shaped structure. In another embodiment, the base member 102 have any desired shape, such as, by way of non-limiting example, cylindrical, oval, or rectangular. In one embodiment, the pair of first support member 104*a* and the pair of second support member 104*b* is cylindrical in shape. In another embodiment, the pair of first support member 104*a* and the pair of second support member 104*b* have any desired shape, such as, by way of non-limiting example, cylindrical, oval, or rectangular. In one embodiment, the apparatus 100 is made of acrylonitrile butadiene styrene (ABC). In one embodiment, the apparatus 100 may be made of any suitable material such as, by way of non-limiting example, plastic, metal, wood or composite materials.

In operation, a user grasps the handles (106*a*, 106*b*) of the exercise apparatus 100 with the bottom surface of the base member 102 on a floor or any other suitable surface. Thereafter, the user may support their body above the exercise apparatus 100 and could perform the push-up exercise. As illustrated in FIG. 1, the handles (106*a*, 106*b*) of the exercise apparatus 100 would enable the user to position their hands in a close-grip position, which would result in movements and motions that engage the pectoral muscles and triceps of the user.

Advantageously, the apparatus 100 of the present invention allows the user to perform push-up, particularly in close triceps position or close hand position, without physical strain and injury often associated therewith. The push-up exercise apparatus 100 is adapted to be used by users over a wide range of ages, fitness levels, heights, and weights. Further, the apparatus 100 is provided with portability, compactness and inherent rigidity features. The apparatus 100 is further adapted to use by children, women, men or military personnel. The apparatus 100 further avoids any unnecessary movement as the apparatus 100 comprises a unitary body. The apparatus 100 further enables to adapt a healthy lifestyle, aids in eliminating flabby arms and weak pectoral muscles and sculpts pectoral and triceps muscle. The apparatus further 100 provides a more intense form of exercise; enables a fitness enthusiast to increase upper body and core strength; allows the user to more effectively engage muscles in the arms and chest; provides health-enhancing qualities; helps the user to lose weight; allows the user to perform close-grip push-ups using proper form; allows to more effectively isolate and target the triceps and pectoral muscles, and encourages a healthy lifestyle, while also helps in building confidence of the user. Further, the small and compact structure of the apparatus 100 enables easy portability and storage.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A push-up exercise apparatus, comprising:

a base member having two horizontal portions and a vertical portion, wherein said vertical portion is provided perpendicularly between said two horizontal portions forming an "I" shape;

a pair of spaced apart first support members centrally disposed on said vertical portion of the base member at an acute angle with respect to a ground surface, wherein said pair of spaced apart first support members are parallel with respect to each other;

a pair of spaced apart second support members centrally disposed on said vertical portion of the base member at an acute angle with respect to the ground surface, said pair of spaced apart second support members intersecting with said pair of spaced apart first support members forming a "V" shaped configuration;

a first handle disposed above the pair of spaced apart first support members, and a second handle disposed above the pair of spaced apart second support members.

2. The push-up exercise apparatus according to claim 1, wherein the pair of first support members and the pair of second support members are disposed adjacent to one another.

3. The push-up exercise apparatus according to claim 1, wherein the push-up exercise apparatus is adapted to perform push-up in close triceps position.

4. The push-up exercise apparatus according to claim 1, wherein the push-up exercise apparatus is made of plastic material.

5. The push-up exercise apparatus according to claim 1, wherein the push-up exercise apparatus is made of acrylonitrile butadiene styrene.

6. The push-up exercise apparatus according to claim 1, wherein the first and second handles conform to a user's hand and fingers.

7. The push-up exercise apparatus according to claim 1, wherein the first and second handles are cylindrical in shape.

8. The push-up exercise apparatus according to claim 1, wherein the base member, the first handle, the second handle and the pair of spaced apart first and second support members forms a unitary body.

9. The push-up exercise apparatus according to claim 1, a rear side of the base member comprises a honeycomb texture.

10. A push-up exercise apparatus, comprising:

a. a base provided with two horizontal portions and a vertical portion perpendicular to said horizontal portions forming an "I" shape, said base having a top end and a bottom end, wherein said bottom end is entirely covered with a textured surface provided in a honeycomb texture;

b. a pair of first support members extending from said vertical portion of said base, wherein said pair of first support members are provided as parallel members with respect to each other and extending in an angled direction from said base, wherein said pair of first support members are provided in a forty-five degree angle with respect to a ground surface, a first handle mounted to a top end of said pair of first support members, wherein first handle provided in a cylindrical configuration, said first handle having a width that is greater than a width of said pair of first support members extending outwardly thereout; and c. a pair of second support members extending from said vertical portion of said base, said pair of second support members intersecting with said pair first support members forming a "V" shaped configuration, wherein said pair of second support members are provided as parallel members with respect to each other and extending in an angled direction from said base, wherein said pair of second support members are provided in a forty-five degree angle with respect to said ground surface, a second handle mounted to a top end of said pair of second support members, said second handle provided in a cylindrical configuration, said second handle having a width that is greater than a width of said pair of second support members extending outwardly thereout, wherein said base, said pair of first support members, and said pair of second support members are made of a plastic material, wherein said first handle and said second handle are covered with a foam gripping material.

* * * * *